United States Patent [19]

Mauzin et al.

[11] 3,952,669

[45] Apr. 27, 1976

[54] SNUBBED RAILWAY VEHICLE BOGIE

[76] Inventors: Andre E. Mauzin, 25, rue Jean Dolent, Paris 14 eme; Pierre P. Truffart, 70, rue de Sannois - (95), Ermont; Ferdinand L. Tharel, 10 Square des Credos, (93), Epinay-sur-Seine, all of France

[22] Filed: Apr. 23, 1973

[21] Appl. No.: 354,156

Related U.S. Application Data

[63] Continuation of Ser. No. 86,238, Nov. 2, 1970, abandoned.

[30] Foreign Application Priority Data

Nov. 2, 1969 France ..... 69.37973

[52] U.S. Cl. ..... 105/171; 105/182 R; 105/197 A; 105/199 A; 105/218 A; 105/224.1; 105/453

[51] Int. Cl.[2] ..... B61F 3/08; B61F 5/08; B61F 5/24; B61F 5/30

[58] Field of Search ..... 105/171, 182 R, 197 A, 105/199 R, 199 F, 218 A, 224.1, 453, 199 A

[56] References Cited

UNITED STATES PATENTS

| | | | |
|---|---|---|---|
| 1,029,919 | 6/1912 | Epstein | 105/182 R |
| 1,485,224 | 2/1924 | Hamilton | 105/218 A |
| 2,197,727 | 4/1940 | Ledwinka | 105/182 R |
| 2,242,422 | 5/1941 | Eksergian | 105/182 R |
| 2,545,956 | 3/1951 | Julien | 105/182 R |
| 2,861,522 | 11/1958 | Rossell | 105/171 |
| 2,908,230 | 10/1959 | Dean | 105/182 R |
| 2,954,747 | 10/1960 | Hirst et al. | 105/196 |
| 3,521,569 | 7/1970 | Muotka | 105/224.1 X |
| 3,538,856 | 11/1970 | Lich | 105/182 R |
| 3,650,219 | 3/1972 | Seely | 105/182 R |

*Primary Examiner*—Robert J. Spar
*Assistant Examiner*—Howard Beltran
*Attorney, Agent, or Firm*—Brisebois & Kruger

[57] ABSTRACT

A railway vehicle bogie has a primary stage suspension between the undercarriage and the axle boxes consisting of resilient chevron blocks having high vertical flexibility and transverse rigidity, and a second stage suspension between the undercarriage and the vehicle having reduced vertical flexibility and high horizontal flexibility, the secondary suspension being formed only of vertically superposed resilient blocks operating in compression and having their axis of compression inclined with respect to the vehicle body, the blocks being distributed about an imaginary centre of pivotal movement of the bogey with respect to the vehicle body.

4 Claims, 15 Drawing Figures

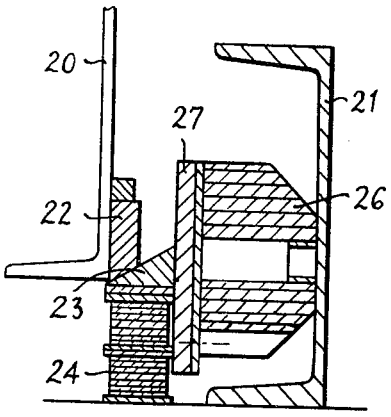
Fig.9
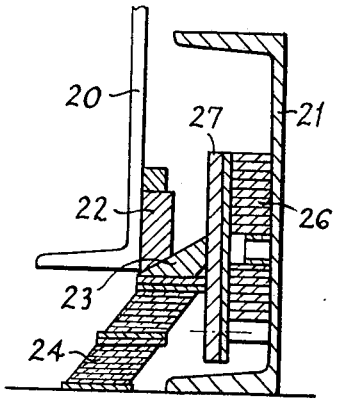
Fig.10
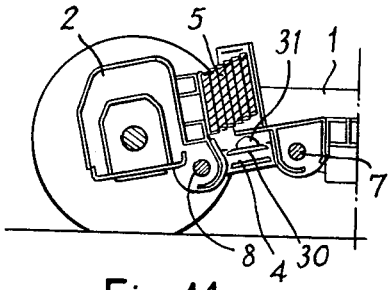
Fig.11
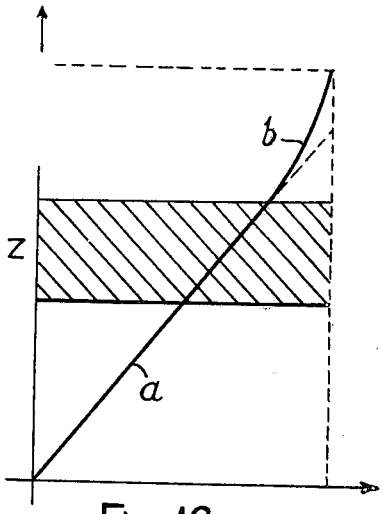
Fig.12
Fig.13
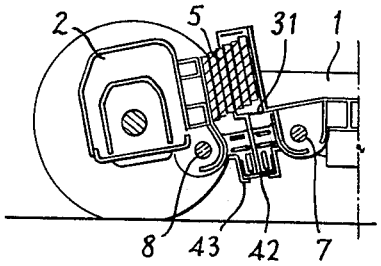
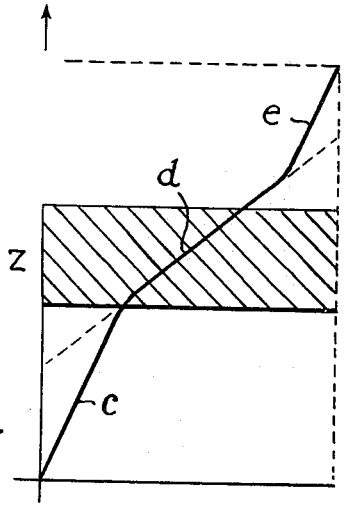
Fig.14

SNUBBED RAILWAY VEHICLE BOGIE

This application is a continuation of copending application Ser. No. 86,238, filed Nov. 2, 1970, now abandoned.

The present invention relates to a railway vehicle in which the body is supported by bogies and more particularly to a railway wagon for the transport of fragile merchandise at high speeds, for example early fruit and vegetables, the railway vehicle can equally be a passenger vehicle.

A bogie for such a railway vehicle comprises a resilient suspension having two stages, namely (a) a first stage between the bogie frame of the bogie and the axle boxes, consisting of resilient chevron shaped blocks of high vertical flexibility and transverse rigidity, and (b) a second stage between the bogie frame and the vehicle body connecting only in resilient interleaved compression blocks of horizontal flexibility and relative vertical rigidity; the said compression blocks are distributed about an imaginary center of pivotal movement of the bogie with respect to the vehicle body, and have their axis of compression slightly inclined so as to converge upwardly, said blocks operating in shear to ensure transverse and rotational adjustment of the bogie with respect to the body and to allow a limited inclination of the vehicle body on a curved track.

In this bogie, which thus has no sliding blocks or bolsters, the members subject to wear are consequently worn to the maximum extent; its maintenance is minimal and its construction economical by reason of its simplicity. Moreover, it is light and its non-suspended masses are kept to a strict minimum. Finally its properties for damping vibrations ensure very quiet operation, without reactions on the track.

It allows considerable transverse play of the body, which may reach ±65 mm in alignment, this play being reduced to 27 mm for example, on a curve of radius 250m.

Other features will appear from the description which is given hereinunder by way of example of one embodiment with reference to the accompanying drawings in which:

FIGS. 7, 8, 9 and 10 are highly diagrammatic detail views on a larger scale and in transverse vertical section taken along the line A—A of FIG. 4, showing the stop device with an action proportional to the load produced;

FIG. 11 shows diagrammatically a first embodiment of the first stage of the suspension shown in FIG. 5;

FIG. 12 is a graph of corresponding elasticity;

FIG. 13 shows diagrammatically a second embodiment of the first stage of the suspension shown in FIG. 6;

FIG. 14 is a graph of corresponding elasticity;

Figure 1:
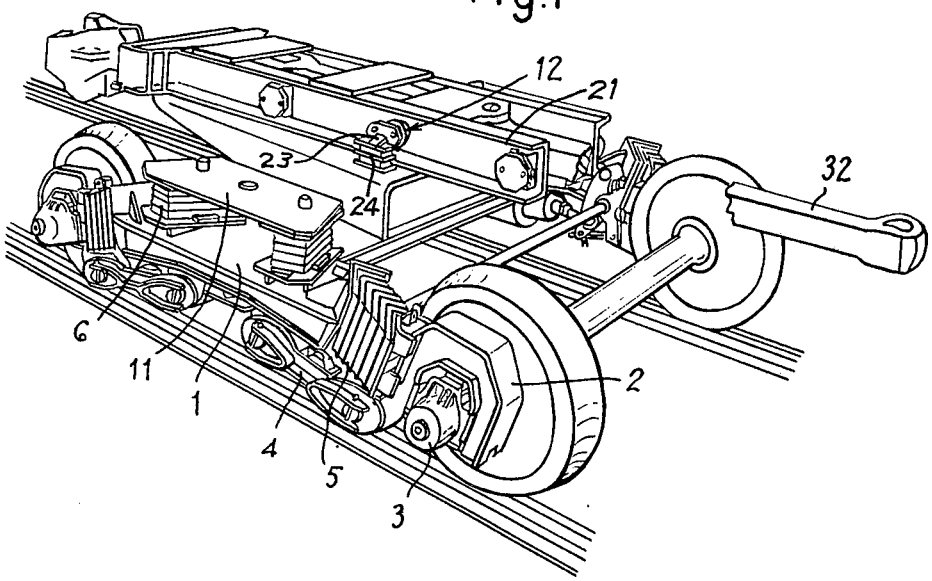
FIG. 1 shows in perspective the assembly of a bogie carrying an automatic coupling device of known type.
Figure 2:
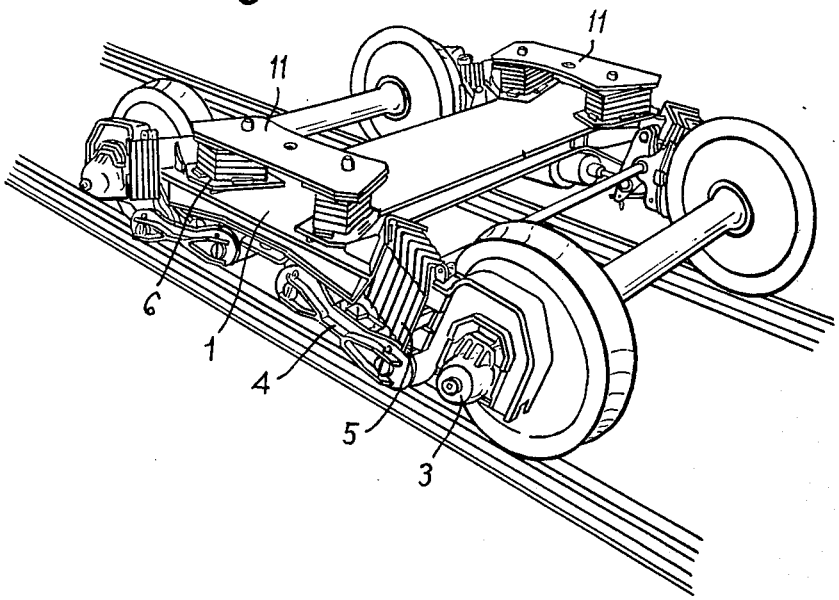
FIG. 2 shows the same bogie without the coupling device.

The frame of the bogey is indicated generally by numeral 1. Its side members terminate in girder members 2 which receive the axle-boxes 3 and which are articulated to the side members by means of links 4.

It is to be noted that the cage form of the members 2 has been adapted to receive, without modification, axle-boxes of different types (e.g. boxes having two spherical, conical, or cylindrical runners or even boxes having a single swivel runner).

The suspension has two stages as previously described, the primary stage comprising resilient chevron shaped blocks 5, and the secondary stage being formed by resilient horizontal vertically superposed interleaved blocks 6.

The blocks 5 as well as the blocks 6 are formed, in known manner, by stacking elements of natural rubber or of a suitable eldstomer alternating with steel insertions to which they adhere in known manner.

The pivotal axes of the links 4 on the bogie frame and on the members 2 are denoted by 7 and 8 respectively.

The geometry of the bogie is so arranged that the blocks 5, suitably inclined and disposed on one side of the corresponding axle, operate both in shear and in compression, in optimum proportions. These blocks 5 have high vertical flexibility substantially without transverse deformation due to the chevron structure. On the other hand, the links 4 have high transverse rigidity backing up that of the blocks 5.

Figure 4:
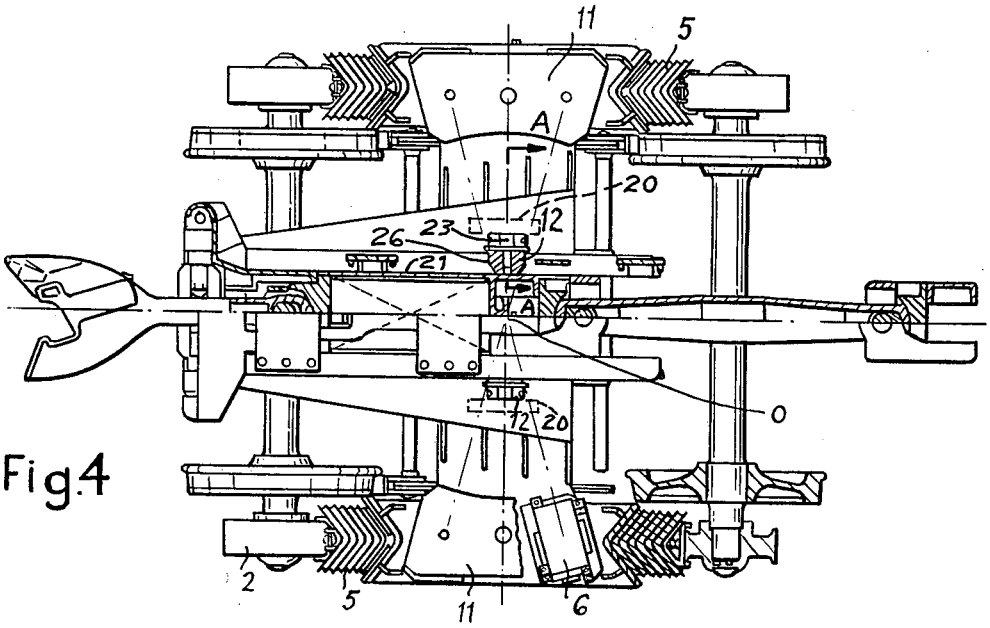
FIG. 4 is a view partly in plan and partly in horizontal section.

As shown in FIG. 4 the blocks 6, when not subjected to stress, are distributed in a support polygon coaxial with the imaginary pivotal centre 0 of the bogie with respect to the body.

Figure 5:
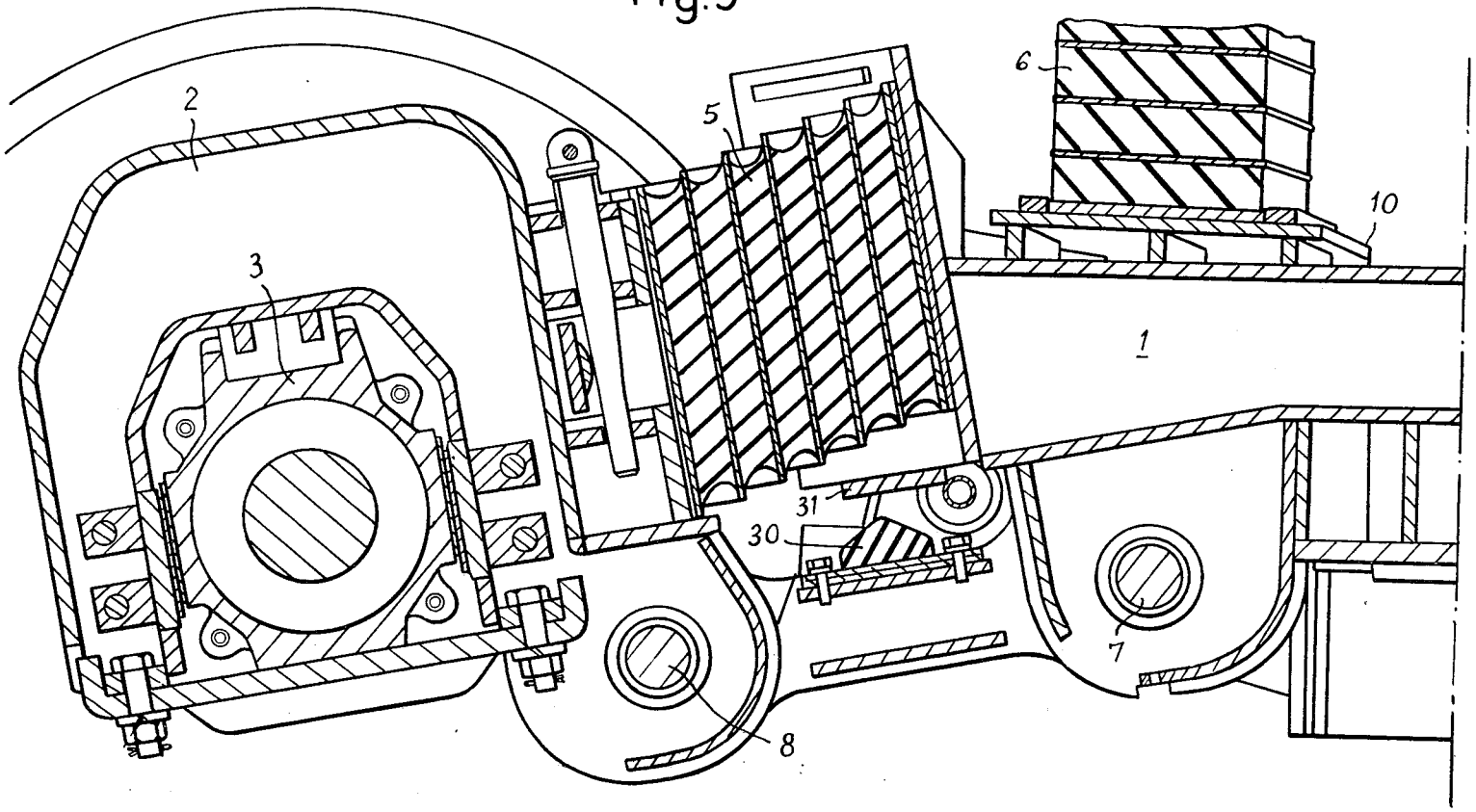
FIG. 5 is a detailed view on a larger scale and in longitudinal vertical section, of a first embodiment.
Figure 6:
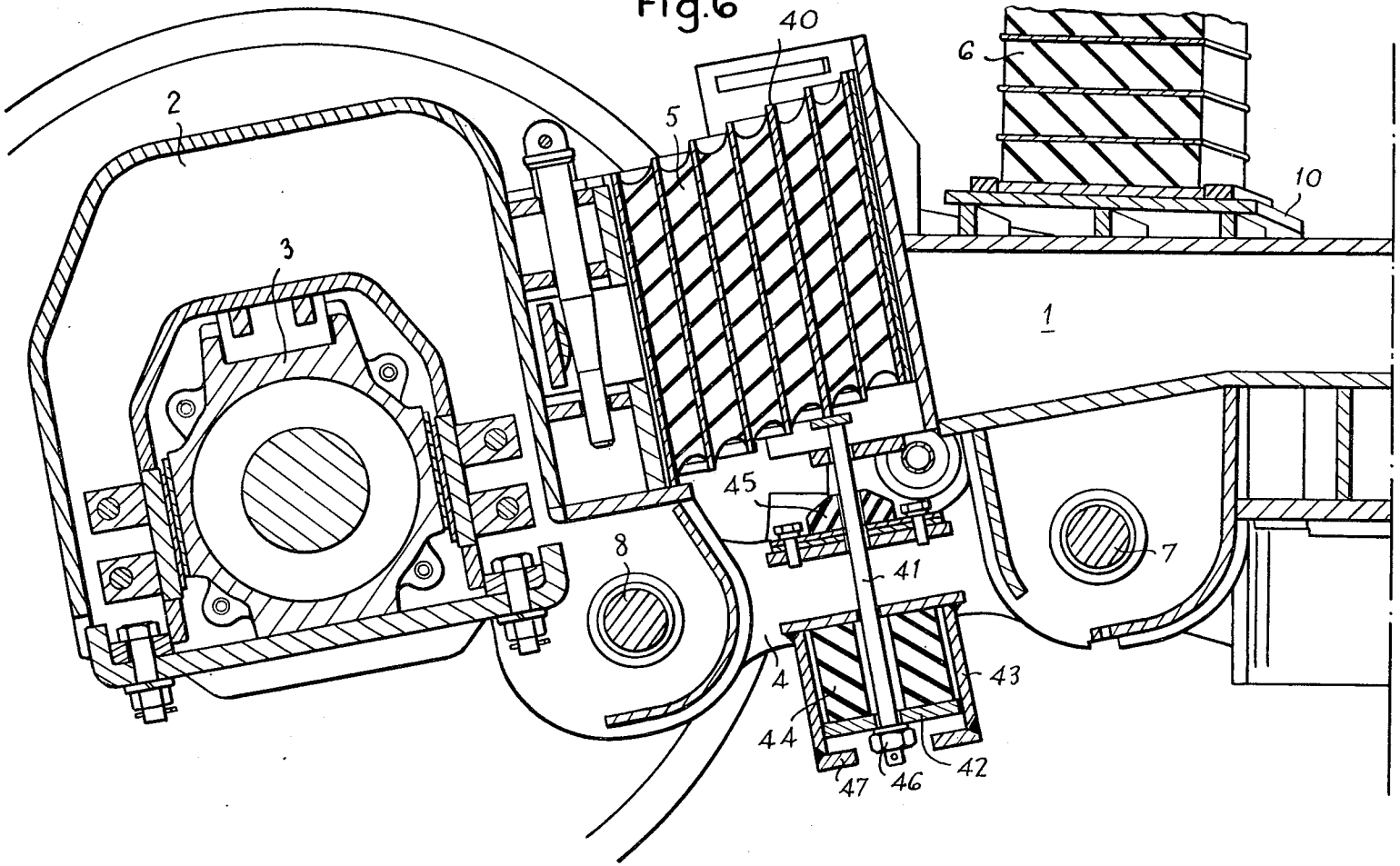
FIG. 6 shows similar views of a modified embodiment.
Figure 15:
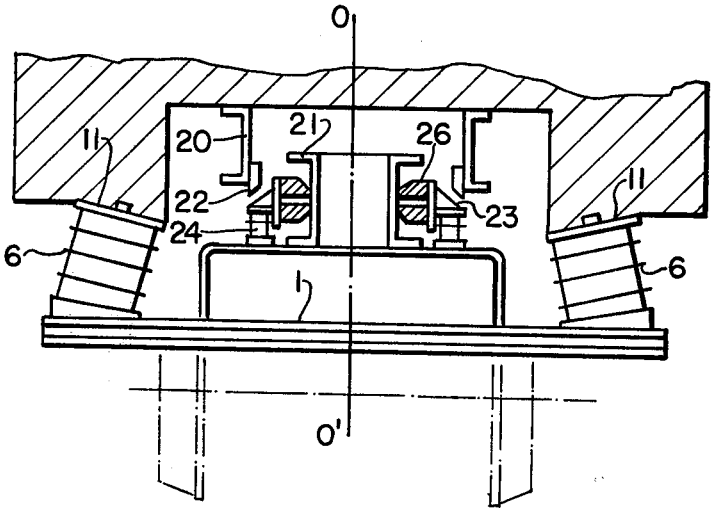
FIG. 15 is a vertical sectional view taken along the line A—A of FIG. 4.

On the other hand, and as is best seen in FIGS. 5 and 6, the compression axes of these blocks 6 are slightly inclined inwardly from the vertical so that their upper surfaces form the faces of a pyramid the apex of which coincides with the point O which enables the inclination of the body to be reduced during its transverse displacement, i.e. these blocks 6 still have an anti-rolling effect thus enabling the usual dampers to be completely omitted. In FIGS. 5 and 6, the keys 10 ensure the obliquity of these blocks and the two plates 11 enable the bogey to be attached to the body.

Thus the blocks 6 have, in addition to a certain elasticity in the vertical direction, three functions namely:

transverse adjustment of the bogie with respect to the body, during displacements of this latter;

rotational adjustment of the bogie;

the anti-rolling function referred to above.

The arrangement includes a device which modifies the characteristics of the suspension in the transverse direction, as a function of the load. The device is indicated generally by 12 in FIGS. 1 and 4 and is shown in detail in FIGS. 7 – 10, in which the undercarriage of the truck is denoted by 20 and the frame of the bogie by 21.

A rigid stop 22 is fixed to the undercarriage of the truck, the corresponding rigid bogie stop being denoted by 23. The latter is connected to the frame of the bogie by means of a vertical stack of resilient blocks 24 which can be deformed transversely. The cooperating faces of the stops 22 and 23 are oblique. Furthermore the bogie carries resilient blocks 26 which operate horizontally and to which are fixed the plates 27 cooperating with the rigid stops 23.

Figure 7:
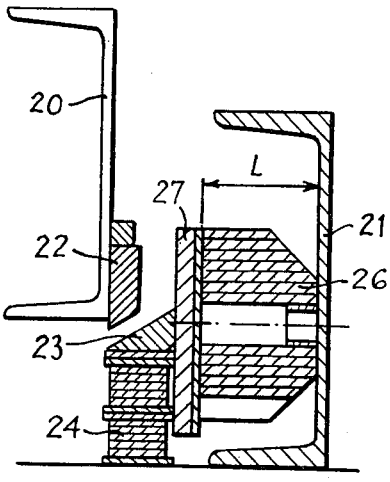
Figure 8:
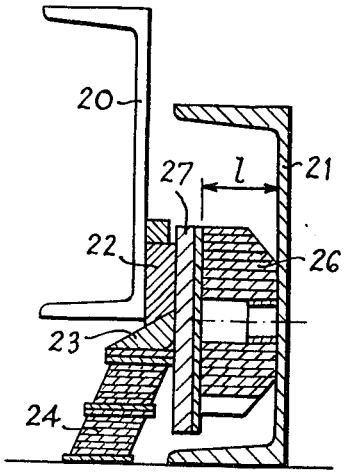

FIGS. 7 and 8 show the relative position of the members of the device under tare. The stops 23 and 22 are separated both in the vertical and in the horizontal directions by reason of the obliquity or their co-operating surfaces. Thus a certain lateral displacement is permitted to the body against the action of the blocks 24 alone before the stops 22, 23 finally come into contact, this displacement being resisted resiliently by deformation of the resilient blocks 26 which are compressed to an extent corresponding to the difference between the magnitudes L and l.

When, on the contrary the truck is loaded, as shown in FIGS. 9 and 10, the rigid stops 22, 23 are in contact with each other from the beginning; and the lateral play of the body is resisted much more forcibly by maximum compression of the resilient blocks 26. It will thus be seen that the transverse adjustment is a function of the load and amplitude of the transverse displacement of the body. An intermediate flexibility and adjustment will correspond to intermediate loads, so that the period of transverse oscillation remains approximately independent of the load, by the very simple means described and shown.

In the vertical direction, the problem consists in obtaining optimum stability of the vehicle especially in the field for example of the transport of fragile foodstuffs, with an almost constant frequency of vertical oscillation. Two modified embodiments for this purpose are shown in FIGS. 5 and 6.

In FIGS. 5 and 11 a resilient stop 30 carried by the bearing 4 co-operates with a rigid counter-stop 31 formed by the frame of the bogie and disposed transversely to the resilient blocks 5.

For a particular load, the resilient stop 30 abuts against the counter-stop 31. The effect thus obtained is shown in FIG. 12 in which the desired zone of stability is hatched and denoted by Z. With light loads, the resilient blocks 5 operate alone and the curve of deflection as a function of load is for example that denoted by *a*. From the instant when the stop 30 comes into contact with the fixed counter-stop 31, the suspension is hardenend, as indicated at part *b* of the curve, by reason of the operation and compression of stop 30.

It will be understood that the response of the corrected suspension thus produced can be modified, whilst remaining within the limits of the desired contact separation by imparting any desired shape or cross-section to the stop 30 as well as displacing it in the longitudinal direction.

This response can be selected, for example, with a view to obtaining maximum flexibility in the field of loads Z indicated.

FIGS. 6 and 13 show a more developed solution which enables the response curve of FIG. 14 to be obtained where it can be seen that the area Z of optimum flexibility is located between two branches of this curve corresponding to a harder suspension, always within the permissible limits.

For the vehicle under tare, the flexibility of the suspension will be that which corresponds to the portion *c* of the curve.

For this purpose the chevron block 5 is connected by means of one of its interleaved metal insertions 40 and a rod 41, for example welded to the latter, to a plate 42 movable within a box 43 fixed to the lower part of the links 4. At the end of rod 41 is located an adjusting nut 46 which serves as a stop for the plate 42 and which maintains the tension of the spring at a selected value.

The box 43 is provided on its base with stops 47. The nut 46 can pass between the stops 47 but the latter limit displacement of the plate 42.

When the load of the vehicle increases, the cup 42 bears on the stops 47 for a predetermined load. The effect of the resilient member 44 is thus cancelled and the rod 41 then slides across the plate 42.

When the resilient member or spring 44 is compressed and intervenes in the suspension, the device is in the state which corresponds to the part *c* of FIG. 14.

When the cup 42 bears on the stops 47, it is at the intermediate point between the parts *c* and *d* of FIG. 14. Under these conditions, and in the state corresponding to the part *c* of FIG. 14, the rigidity of the spring 44 reinforces that of the resilient block 5 and the suspension is hardened all the more.

When the plate 42 bears on the tops 47 and the rod 41 slides freely across the plate 42, the suspension is only ensured by the chevron block 5; this corresponds to the part *d* of FIG. 14.

For a still greater load, the resilient stop 45 acts in the same manner as the stop 30 of FIG. 5. The suspension hardens all the more as indicated by the part *e* of the curve of FIG. 14 and the device prevents the vertical displacement of the body ("buffer" height) from exceeding the permitted limits.

It is obvious that by suitable modifications of the strength and length of the spring 44 as well as the path of the cup 42, any compression curve of the suspension as a function of the load can be obtained, corresponding to any particular application, the buffer height not being exceeded.

Figure 3:
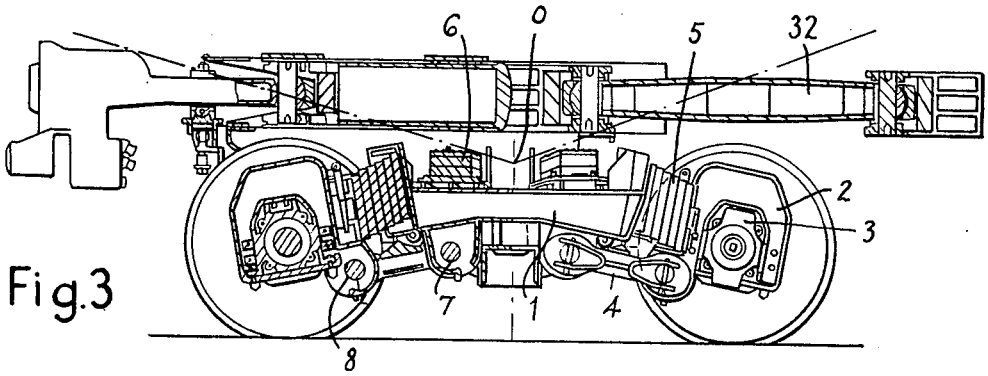
FIG. 3 is a view partly in section and partly in longitudinal vertical section.

Finally, as shown in FIGS. 1 and 3, the automatic coupling device can be mounted directly on the bogie, which ensures excellent guiding of the bogie on the track and avoids "crabbing". For this reason, the stability of the vehicle is improved and abnormal wear on the wheel flanges is avoided. All the traction and compression stresses are directly transmitted to the undercarriage of the vehicle by means of the articulated links 32, in the same horizontal plane as that of the coupling, i.e. under the most favourable conditions.

It is to be understood that various constructional modifications can be made to the different elements of the bogey described and illustrated herein without, however, departing beyond the scope of the invention as defined in the following claims.

We claim:

1. A bogie for a railway vehicle having a bogie frame carrying axle boxes, which bogie also includes a resilient suspension having two stages namely: (a) a primary stage between said bogie frame and said axle boxes, said primary stage consisting of resilient chevron-shaped blocks of high vertical flexibility and transverse rigidity; and (b) a second stage between said bogie frame and the vehicle body, said second stage having reduced vertical flexibility and high horizontal flexibility, said secondary suspension stage being formed only from interleaved resilient blocks operating in compression, said blocks being distributed about an imaginary center of pivotal movement of said bogie with respect to said body and having an axis of compression which is slightly inclined with respect to said body so as to converge upwardly and to operate in shear to ensure transverse and rotational adjustment of said bogie and reduced inclination of said body on a curved track, and a device adapted to change the transverse characteristics of the second stage of the suspension in dependence upon the load, and said device comprising a rigid body stop fixed to said vehicle body and cooperating with a rigid bogie stop, the latter being coupled to said bogie frame vertically by means of a first set of resilient blocks and horizontally by means of a second set of resilient blocks, said resilient blocks mounted on said bogie frame, said rigid body stop and said rigid bogie stop having mutually cooperating oblique surfaces which are spaced apart when said vehicle is unloaded but engaged when said body is loaded, whereby any given transverse movement of said bogie causes greater compression of said second set of resilient blocks when said body is loaded than when it is unloaded.

2. A bogie for a railway vehicle having a bogie frame carrying axle boxes, which bogie also includes a resilient suspension having two stages namely: (a) a primary stage between said bogie frame and said axle boxes, said primary stage consisting of resilient chevron-shaped blocks of high vertical flexibility and transverse rigidity; and (b) a second stage between said bogie frame and the vehicle body said second stage having reduced vertical flexibility and high horizontal flexibility, said secondary suspension stage being formed only from interleaved resilient blocks operating in compression, said blocks being distributed about an imaginary center of pivotal movement of said bogie with respect to said body and having an axis of compression which is slightly inclined with respect to said body so as to converge upwardly and to operate in shear to ensure transverse and rotational adjustment of said bogie and reduced inclination of said body on a curved track, and further comprising guide members which receive said axle-boxes and which are connected to said bogie frame by link means, said chevron-shaped blocks associated with said primary stage of said suspension being interposed between said guide members and said bogie frame, and devices to stiffen said primary suspension, each of said devices being associated with one of said link means and with one of said chevron-shaped blocks and comprising a resilient member compressed between said link means and a plate member connected to the said chevron-shaped block so that the stiffness of said resilient member reinforces that of said chevron-shaped block for a truck under tare and with small loads, thereby hardening the primary suspension, the arrangement being such that at higher loads the said resilient member is ineffective, each of said devices comprising further a resilient stop with progressive rigidity, interposed between said link means and a fixed stop borne by said frame at an intermediate point along the length of said link means in order to harden the primary suspension at the highest loads of the truck.

3. A railway vehicle having a body supported by a bogie having a bogie frame and axle boxes and comprising a two-stage resilient suspension namely: (a) a primary stage between said bogie frame and said axle boxes, including resilient chevron-shaped blocks of vertical flexibility and relative transverse rigidity; and (b) a second stage between said bogie frame and said vehicle body consisting only of resilient interleaved compression blocks of horizontal flexibility and relative vertical rigidity, wherein said compression blocks are distributed about an imaginary vertical axis of pivotal movement of said bogie with respect to said body and have their axes of compression slightly inclined so as to converge upwardly towards said vertical pivotal axis, said blocks operating in shear to ensure transverse and rotational adjustment of said bogie with respect to said body and to allow a limited inclination of said body on a curved track, and a device adapted to change the transverse characteristics of the second stage of the suspension as a function of the load, and comprising a rigid body stop cooperating with a rigid bogie stop, the latter being coupled to said bogie frame, vertically by means of a first set of resilient blocks and horizontally by means of a second set of resilient conical blocks of progressive rigidity, said resilient blocks mounted on said bogie frame, said rigid body stop and said rigid bogie stop having mutually cooperating oblique surfaces which are spaced apart when said vehicle is unloaded but engaged when said body is loaded, whereby any given transverse movement of said bogie causes greater compression of said second set of resilient blocks when said body is loaded than when it is unloaded.

4. A railway vehicle having a body supported by a bogie comprising a bogie frame and axle boxes and a two-stage resilient suspension namely: (a) a primary stage between said bogie frame and said axle boxes, said primary suspension stage including resilient chevron-shaped blocks of vertical flexibility and relative transverse rigidity; and (b) a second stage between said bogie frame and said vehicle body consisting only of resilient interleaved compression blocks of horizontal flexibility and relative vertical rigidity wherein said compression blocks are distributed about an imaginary vertical axis of pivotal movement of said bogie with respect to said body and have their axes of compression slightly inclined so as to converge upwardly toward said vertical pivotal axis, said blocks operating in shear to ensure transverse and rotational adjustment of said bogie with respect to said body and to allow a limited inclination of said body on a curved track, said bogie further including girder members in which said axle boxes are located, and said bogie frame being connected to said girder members by respective ones of said resilient chevron-shaped blocks of said primary suspension stage and by respective links located under said resilient-shaped blocks, and devices to stiffen said primary suspension, each of said devices being associated with one of said link means and with one of said chevron-shaped blocks and comprising a resilient member compressed between said link means and a plate member connected to the said chevron-shaped block so that the stiffness of said resilient member reinforces that of said chevron-shaped block for a truck under tare and with small loads, thereby hardening the primary suspension, the arrangement being such that at higher loads the said resilient member is ineffective, each of said devices comprising further a resilient stop with progressive rigidity, interposed between said link means and a fixed stop borne by said frame at an intermediate point along the length of said link means in order to harden the primary suspension at the highest loads of the truck.

* * * * *